US010871272B2

(12) United States Patent
Edmark

(10) Patent No.: US 10,871,272 B2
(45) Date of Patent: Dec. 22, 2020

(54) FURLABLE LAMP

(71) Applicant: John Thomas Edmark, Menlo Park, CA (US)

(72) Inventor: John Thomas Edmark, Menlo Park, CA (US)

( * ) Notice: Subject to any disclaimer, the term of this patent is extended or adjusted under 35 U.S.C. 154(b) by 0 days.

(21) Appl. No.: 16/834,456

(22) Filed: Mar. 30, 2020

(65) Prior Publication Data

US 2020/0309352 A1 Oct. 1, 2020

Related U.S. Application Data

(60) Provisional application No. 62/827,214, filed on Apr. 1, 2019.

(51) Int. Cl.
*F21V 14/00* (2018.01)
*F21V 21/14* (2006.01)
*F21V 3/06* (2018.01)

(52) U.S. Cl.
CPC ..... *F21V 14/00* (2013.01); *F21V 3/06* (2018.02); *F21V 21/14* (2013.01)

(58) Field of Classification Search
CPC ..... F21V 14/00; F21V 3/06; F21V 21/14
USPC ..... 362/278
See application file for complete search history.

(56) References Cited

U.S. PATENT DOCUMENTS 3,870,062 A * 3/1975 Medlin ..... A45B 19/04 135/20.3
4,446,506 A * 5/1984 Larson ..... G03B 15/02 362/17
6,176,598 B1 * 1/2001 Seligman ..... F21V 7/18 362/278
2007/0008712 A1 * 1/2007 Schnitzer ..... B63C 9/20 362/96
2012/0320606 A1 * 12/2012 Vossoughi ..... F21V 1/22 362/351
2016/0047522 A1 * 2/2016 Weekamp ..... F21V 7/18 362/278
2016/0053963 A1 * 2/2016 Weekamp ..... F21V 1/146 362/278

* cited by examiner

*Primary Examiner* — Bryon T Gyllstrom
(74) *Attorney, Agent, or Firm* — Birch, Stewart, Kolasch & Birch, LLP

(57) ABSTRACT

A furlable lamp includes a translucent flexible sheet having left and right halves, a bent spine connecting the left and right halves, an opening and a space located between the left and right halves, a supporting structure including a plurality of hollow frame pairs and a light base pair, and a light source disposed on the light base pair. The opening is gradually narrowed from a first end to a second end of the translucent flexible sheet. Each of the hollow frame pairs and light base pair, which are arranged one by one from the first end to the second end of the translucent flexible sheet, includes left and right units symmetrically fixed on the left and right halves of the sheet respectively. The furlable lamp is capable of furling and unfurling to change the shape and light-emitting effect thereof.

15 Claims, 13 Drawing Sheets

FURLABLE LAMP

BACKGROUND OF THE INVENTION

1. Field of the Invention

The present invention relates generally to lamps and more particularly, to a furlable lamp which is capable of furling and unfurling like a fern frond.

2. Description of the Related Art

The conventional lamps usually have unchangeable shape, or may have one or two rotatable joints and thereby bendable by the user to change the height or direction of the light. Such lamps are monotonous in shape and light-emitting effect thereof.

SUMMARY OF THE INVENTION

Therefore, it is an objective of the present invention to provide a furlable lamp which is capable of furling and unfurling to change the shape and light-emitting effect thereof.

To attain the above objective, the present invention provides a furlable lamp which includes a translucent flexible sheet, a supporting structure, and a light source. The translucent flexible sheet includes a left half and a right half. The translucent flexible sheet is configured in a curved manner with a space within the left half and the right half and an opening gradually narrowed from a first end of the translucent flexible sheet to a second end of the translucent flexible sheet. The supporting structure is connected with the translucent flexible sheet and configured to constrain the translucent flexible sheet to furl when the opening is widened and constrain the translucent flexible sheet to unfurl when the opening is narrowed. The light source is disposed to the translucent flexible sheet in the space for emitting light in the space and out of the opening.

As a result, in the primary condition, the combination of the translucent flexible sheet and the supporting structure is a little curved. When an external force is applied to the combination of the translucent flexible sheet and the supporting structure to widen the opening, the combination of the translucent flexible sheet and the supporting structure will be forced to gradually furl along with the increasing of the width of the opening. In other words, the furlable lamp is capable of furling and unfurling along with the change of the width of the opening. When the furlable lamp is in an unfurled state, the light from the light source may be emitted from a relatively higher position and then mostly emitted out directly. When the furlable lamp is in a furled state, the light from the light source may be emitted from a relatively lower position into the space and then emitted out through the translucent flexible sheet. Therefore, by furling and unfurling, the furlable lamp can change the shape and light-emitting effect thereof.

Preferably, the translucent flexible sheet may include a bent spine connecting the left half and the right half. The opening is located opposite to the spine, and the space is located between the spine and the opening. The supporting structure includes a plurality of hollow frame pairs and a light base pair. Each of the hollow frame pairs and the light base pair includes a left unit and a right unit shaped identically to each other and fixed on the left half and the right half of the translucent flexible sheet respectively. Each of the left units and the right units has a first edge, a second edge located opposite to the first edge and shorter than the first edge, a third edge connecting the first and second edges, and a fourth edge located opposite to the third edge. The left and right units of each of the hollow frame pairs and the light base pair are disposed symmetrically to each other in a way that the first edges thereof are located adjacent to the spine. The hollow frame pairs and the light base pair are arranged one by one from the first end to the second end of the translucent flexible sheet in a way that the fourth edges of the left and right units of one of every two adjacent hollow frame pairs are located adjacent to the third edges of the left and right units of the other hollow frame pair, the light base pair is located at the second end of the translucent flexible sheet and the third edges of the left and right units of the light base pair are located adjacent to the fourth edges of the left and right units of one of the hollow frame pairs. The light source is disposed on the light base pair of the supporting structure. In this way, the lamp of the present invention is relatively better in furlability and light emitting effect.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
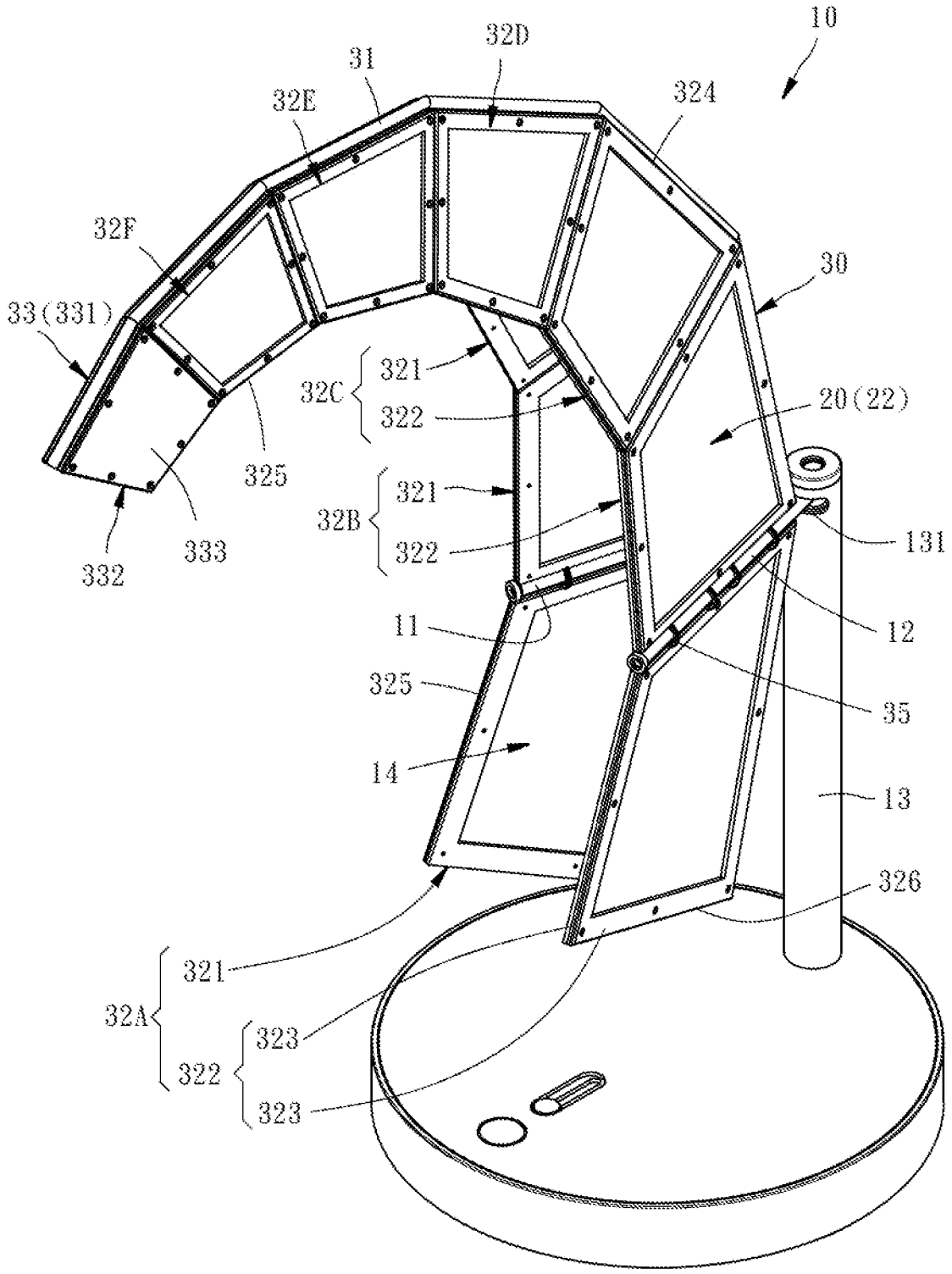
FIGS. 1 and 2 are assembled perspective views of a furlable lamp according to a first preferred embodiment of the present invention.

Referring to FIGS. 1-4, a furlable lamp 10 according to a first preferred embodiment of the present invention includes a translucent flexible sheet 20, a supporting structure 30, left and right axles 11 and 12, a vertical pipe 13, a lamp base 40, and a driving device 50.

The translucent flexible sheet 20 is made of, but not limited to, silicone rubber, which is soft, flexible and thereby capable of being bent and curved into the required shape. The translucent flexible sheet 20 is molded as a non-flat shape having a left half 21, a right half 22, a bent spine 31 connecting the left half 21 and the right half 22, an opening 15 located opposite to the spine 31, and a space 14 located between the left half 21 and the right half 22 and located between the spine 31 and the opening 15. The opening 15 is gradually narrowed from a first end 23 of the translucent flexible sheet 20 to a second end 24 of the translucent flexible sheet 20. In this embodiment, the opening 15 is gradually narrowed from a bottom portion thereof located at the first end 23 to a top portion thereof located at the second end 24.

The spine 31 is a translucent elongated pipe made of, but not limited to, silicone rubber, which is bent into seven segments. The spine 31 may be made integrally with the left and right halves 21 and 22, or may be a separate member fixed on the boundary line between the left half 21 and the right half 22. The spine 31 not only serves as the living hinge connecting the left and right halves 21 and 22, but it is also adapted for containing the electrical wires (not shown) powering the light source which will be further described hereunder.

The supporting structure 30 includes a plurality of hollow frame pairs 32A-F and a light base pair 33. The deformation of the translucent flexible sheet 20 is constrained by the supporting structure 30 described hereunder.

Each of the hollow frame pairs 32A-F includes a left unit 321 and a right unit 322 shaped identically to each other and fixed on the left half 21 and the right half 22 of the translucent flexible sheet 20 respectively. Each of the left and right units 321 and 322 is a hollow frame including two identical pieces 323 each shaped as an irregular quadrilateral frame and made of, but not limited to, aluminum. Each of the left units 321 fixes a part of the left half 21 of the translucent flexible sheet 20 between the two pieces 323 thereof. Each of the right units 322 fixes a part of the right half 22 of the translucent flexible sheet 20 between the two pieces 323 thereof. Each of the left units 321 and the right units 322 has a first edge 324, a second edge 325 located opposite to the first edge 324 and shorter than the first edge 324, a third edge 326 connecting the first and second edges 324 and 325, and a fourth edge 327 located opposite to the third edge 326 and shorter than the third edge 326. For each of the hollow frame pairs 32A-F, the left and right units 321 and 322 are disposed symmetrically to each other in a way that the first edges 324 thereof are located adjacent to the spine 31 and the second edges 325 thereof are located adjacent to the opening 15.

The light base pair 33 includes a left unit 331 and a right unit 332 shaped identically to each other and fixed on the left half 21 and the right half 22 of the translucent flexible sheet 20 respectively. Each of the left unit 331 and the right unit 332 includes two identical plates 333 each shaped as an irregular quadrilateral plate and made of, but not limited to, aluminum. The left unit 331 fixes a part of the left half 21 of the translucent flexible sheet 20 between the two plates 333 thereof. The right unit 332 fixes a part of the right half 22 of the translucent flexible sheet 20 between the two plates 333 thereof. Each of the left unit 331 and the right unit 332 has a first edge 334, a second edge 335 located opposite to the first edge 334 and shorter than the first edge 334, a third edge 336 connecting the first and second edges 334 and 335, and a fourth edge 337 located opposite to the third edge 336 and shorter than the third edge 336. The left and right units 331 and 332 are disposed symmetrically to each other in a way that the first edges 334 thereof are located adjacent to the spine 31 and the second edges 335 thereof are located adjacent to the opening 15.

Figure 3:
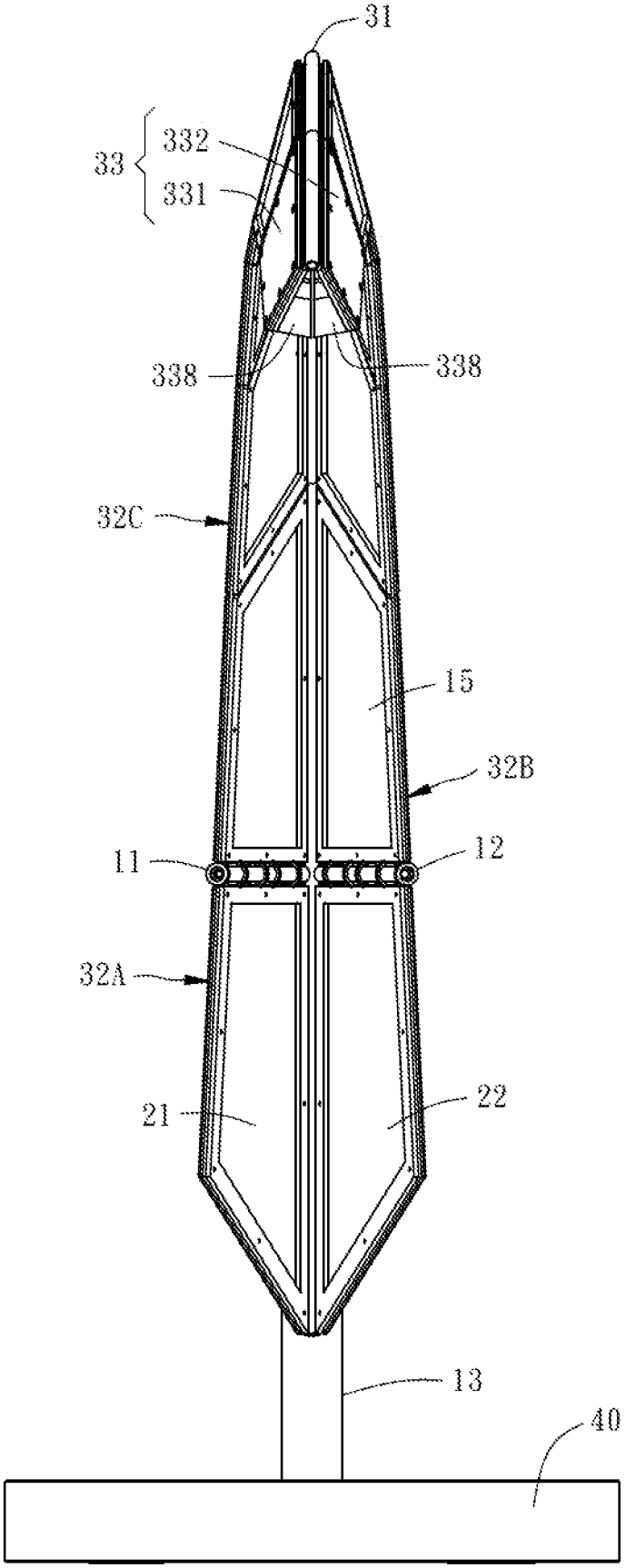
FIG. 3 is a front view of the furlable lamp.
Figure 4:
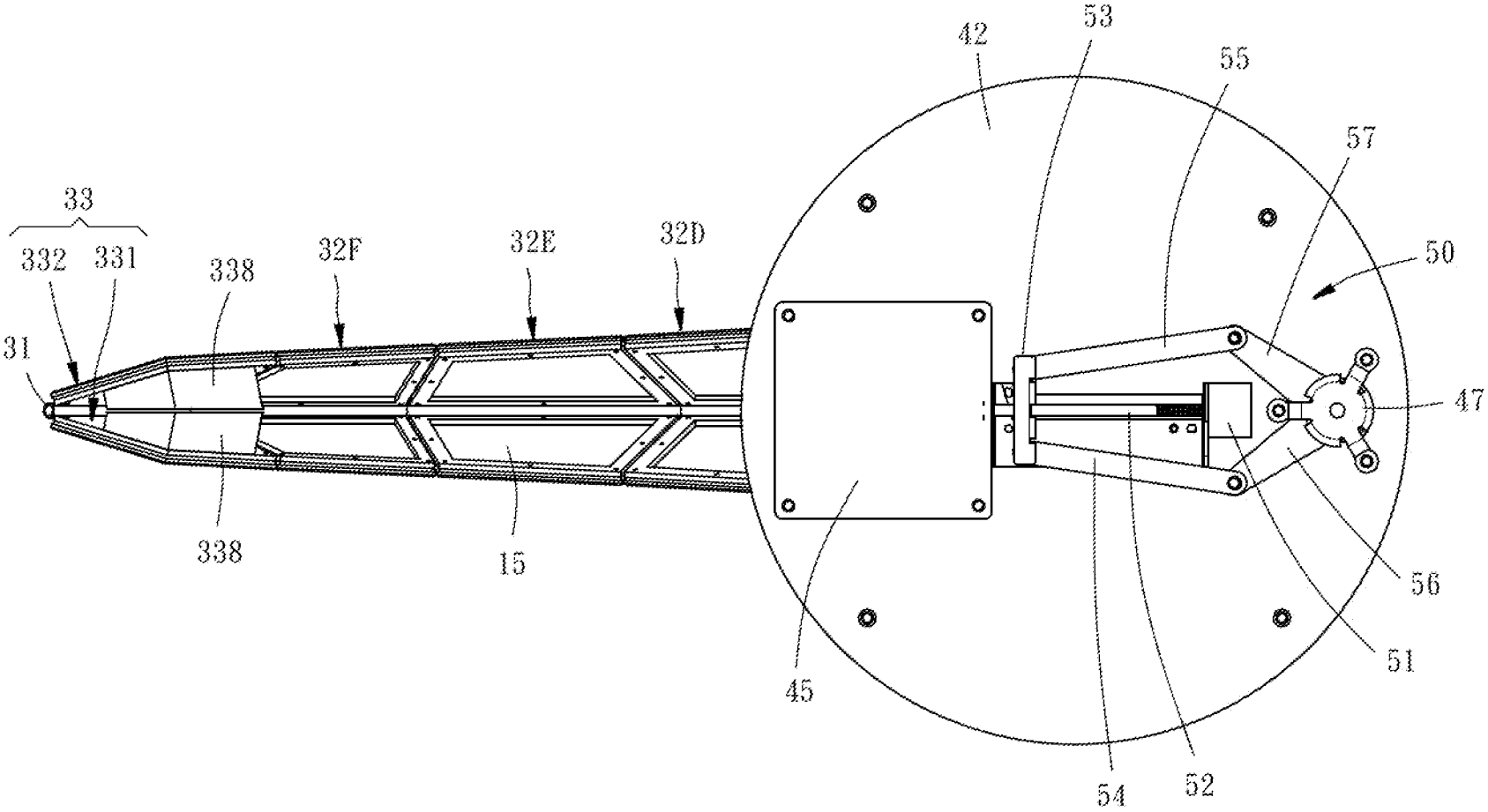
FIG. 4 is approximately a bottom view of the furlable lamp, but not showing a bottom housing of a lamp base of the furlable lamp.

The hollow frame pairs 32 A-F and the light base pair 33 are provided in order of decreasing size from the hollow frame pair 32A to the light base pair 33 and arranged one by one in order of size from the first end 23 to the second end 24 of the sheet 20. That means the hollow frame pair 32A located at the first end 23 is the largest hollow frame pair, the hollow frame pair 32B is smaller than the hollow frame pair 32A, the hollow frame pair 32C is smaller than the hollow frame pair 32B, and so on, and the light base pair 33 located at the second end 24 is smaller than the smallest hollow frame pair 32F. Specifically speaking, for every two adjacent hollow frame pairs, the fourth edges of the left and right units of one of the two hollow frame pairs are sized identically to and located adjacent to the third edges of the left and right units of the other hollow frame pair. For example, for the adjacent hollow frame pairs 32A and 32B, the fourth edges 327 of the left and right units 321 and 322 of the hollow frame pair 32A are equal in length to and located adjacent to the third edges 326 of the left and right units 321 and 322 of the hollow frame pair 32B. Besides, for the smallest hollow frame pair 32F and the light base pair 33, the third edges 336 of the left and right units 331 and 332 of the light base pair 33 are sized identically to and located adjacent to the fourth edges 327 of the left and right units 321 and 322 of the hollow frame pair 32F. As shown in FIGS. 3-4, the opening 15 is gradually narrowed from the largest hollow frame pair 32A to the light base pair 33.

In the present invention, when it is mentioned that the opening 15 is gradually narrowed from the first end 23 to the second end 24, from the bottom portion thereof to the top portion thereof, or from the hollow frame pair 32A to the light base pair 33, it means the width of the opening 15 is gradually diminished in size. The "narrowing" is simply a result of the fact that the pairs 32A-F and 33 are getting smaller; the angle between the left and right units is always identical for all pairs 32A-F and 33, regardless of the amount of furling. The width of the opening 15 is gradually diminished in size, but the angle between the left and right halves 21 and 22 of the translucent flexible sheet 20 is identical from the first end 23 to the second end 24.

As shown in FIGS. 3-4, each of the left and right units 331 and 332 of the light base pair 33 is provided on the inner side thereof with a light source 338. Each light source 338 includes a transparent cover and an LED light disposed in the cover, wherein only the cover is shown in the figures, the LED light is located in the cover and thereby not shown in the figures. The light sources are located in the space 14 for emitting light in the space 14 and out of the opening 15.

Through the above-described configuration, the combination of the translucent flexible sheet 20 and the supporting structure 30 is divided into seven divisions each having a left part and a right part, and the divisions are connected in a curved manner, so that the combination of the translucent flexible sheet 20 and the supporting structure 30 becomes a lampshade capable of furling and unfurling like a fern frond by the driving of the driving device 50, that will be described hereunder. In another embodiment, the combination of the translucent flexible sheet 20 and the supporting structure 30 may be configured having more or less divisions. In still another embodiment, each of the left and right units 321 and 322 may be configured as one single piece (frame) fixedly mounted to an internal surface or an outer surface oft the left half 21 or the right half 22.

Figure 2:
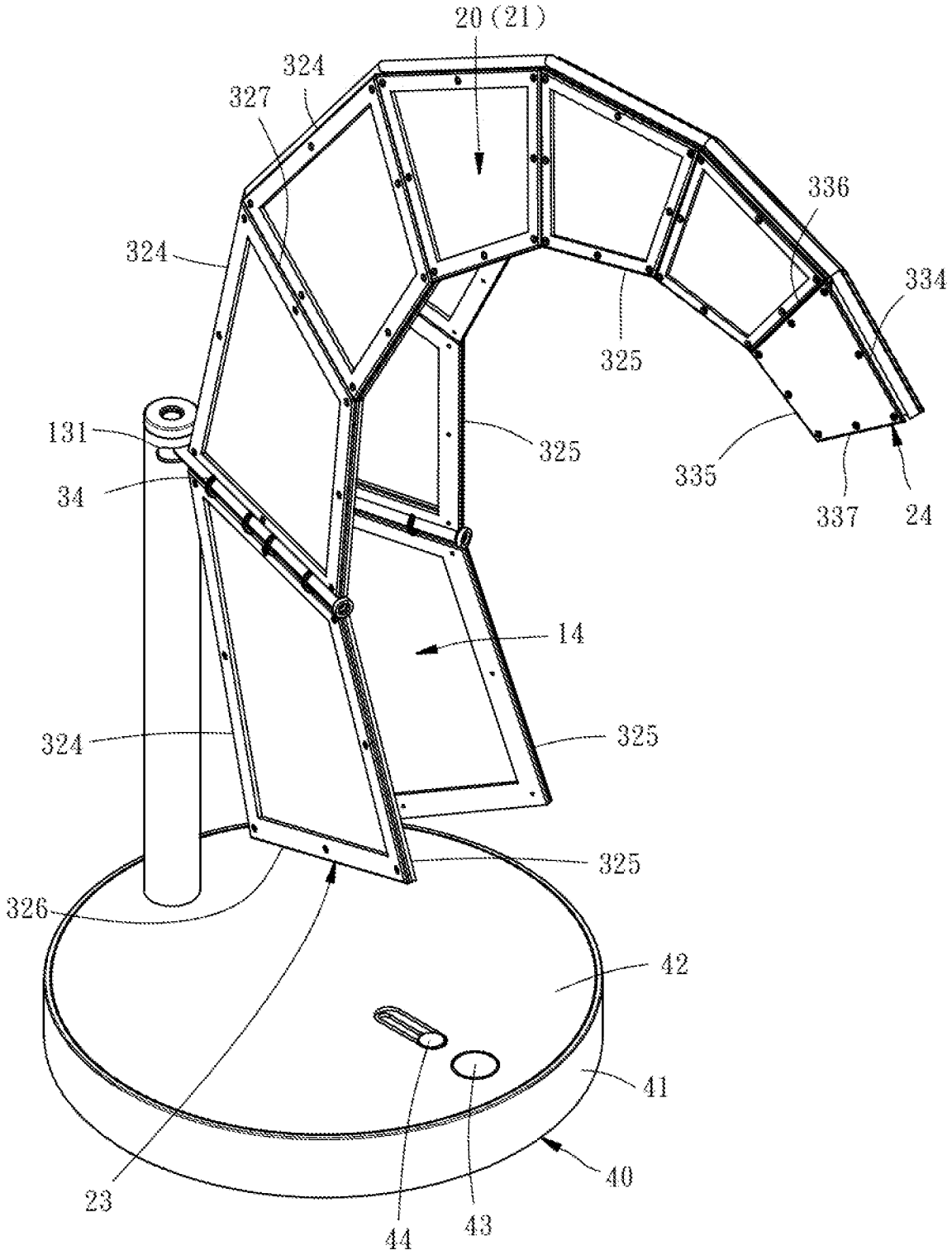
Figure 5:
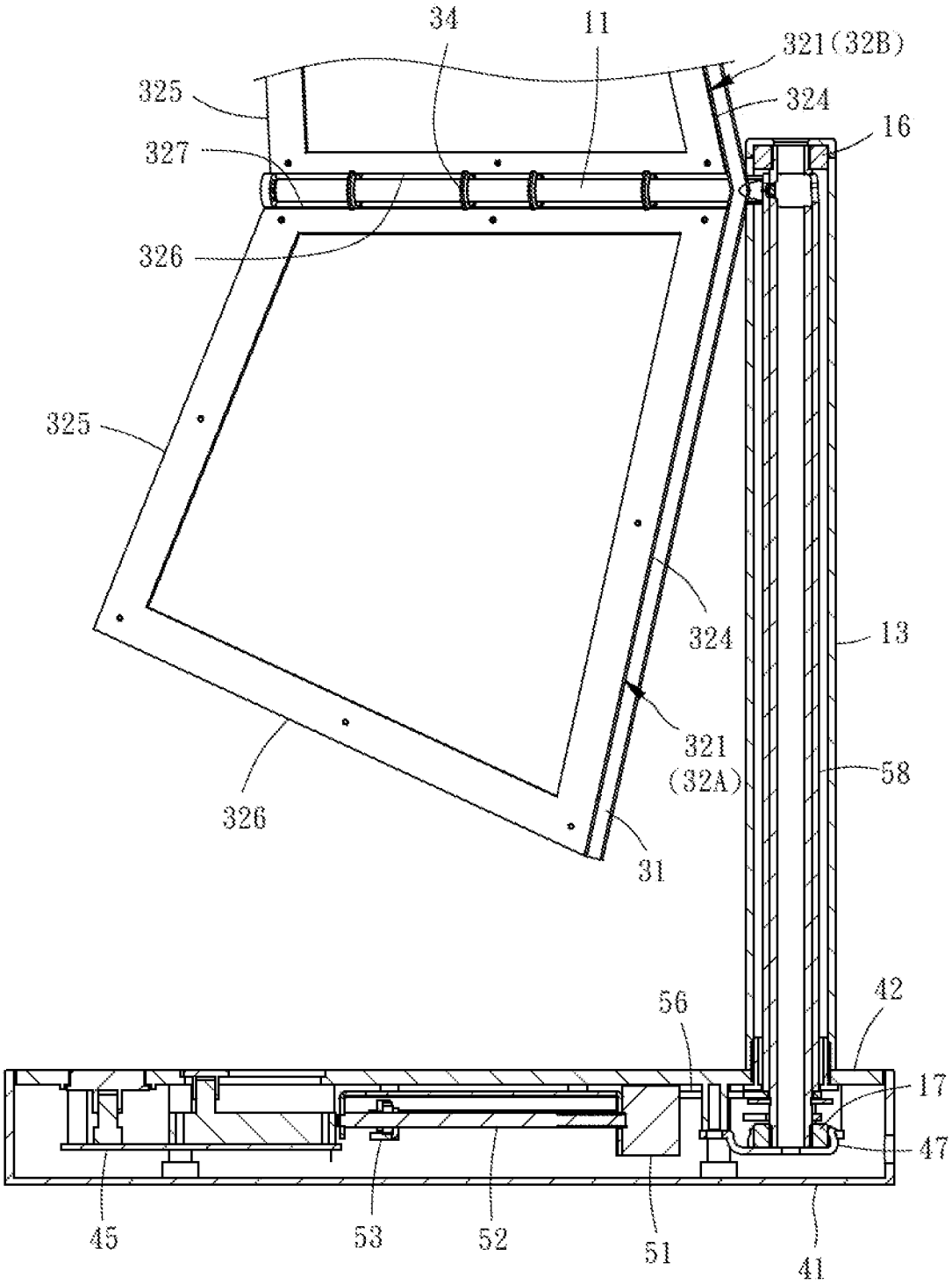
FIGS. 5 and 6 are sectional views showing the bottom parts of the left half and the right half of the furlable lamp.
Figure 6:
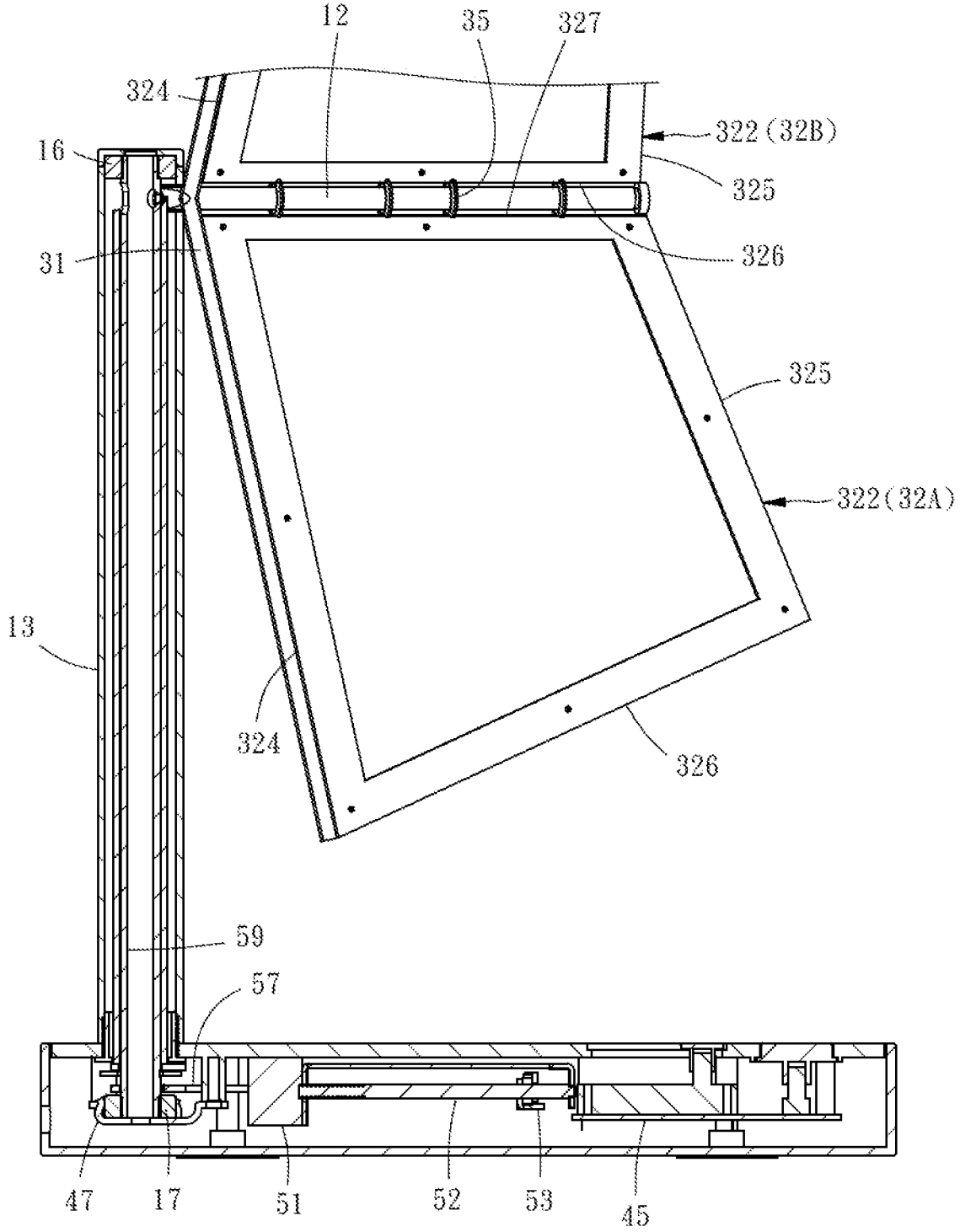
Figure 7:
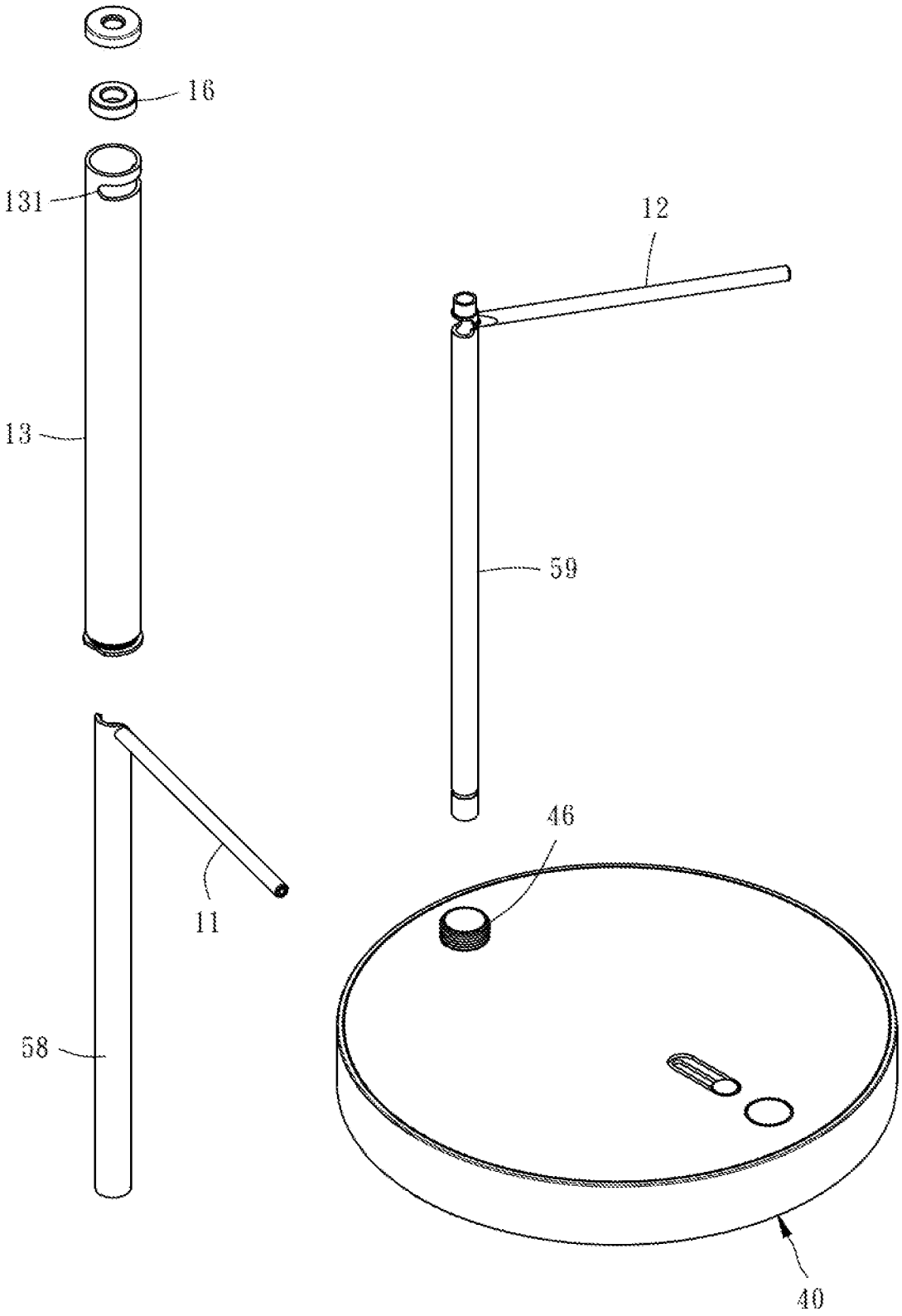
FIG. 7 is an exploded perspective view of the partial furlable lamp.

As shown in FIG. 2, the lamp base 40 includes a bottom housing 41, a top cover 42 covering the bottom housing 41, a power switch 43 disposed on the top cover 42 for controlling the light source, and a sliding switch 44 disposed on the top cover 42 for controlling the driving device 50. As shown in FIGS. 4-6, a circuit board 45 is disposed in the bottom housing 41. The power switch 43 and the sliding switch 44 are electrically connected to the circuit board 45. The bottom section of the vertical pipe 13 is fixedly screwed onto an external threaded member 46 (as shown in FIG. 7) fixed on the top cover 42, so that the vertical pipe 13 extends upwardly from the lamp base 40. The top section of the vertical pipe 13 is provided with a slot 131.

As shown in FIG. 4, the driving device 50 includes a rotary motor 51, a threaded rod 52 connected with the rotary motor 51 and driven by the rotary motor 51 to rotate, a nut unit 53 screwed onto the threaded rod 52 and driven by the threaded rod 52 to displace along the threaded rod 52, a first left link 54 and a first right link 55 both pivotally connected to the nut unit 53, a second left link 56 and a second right link 57 pivotally connected to the first left link 54 and the first right link 55 respectively. The above-mentioned members of the driving device 50 are disposed in the lamp base 40. As shown in FIGS. 5-7, the driving device 50 further includes two internal pipes 58 and 59 disposed in the vertical pipe 13 coaxially. The top section of the internal pipe 59 is rotatably connected with the top section of the vertical pipe 13 by a bearing 16. The bottom section of the internal pipe 59 is rotatably connected with a fixed base 47 in the bottom housing 41 by a bearing 17. The internal pipe 58 is rotatably sleeved onto the internal pipe 59.

Figure 8:
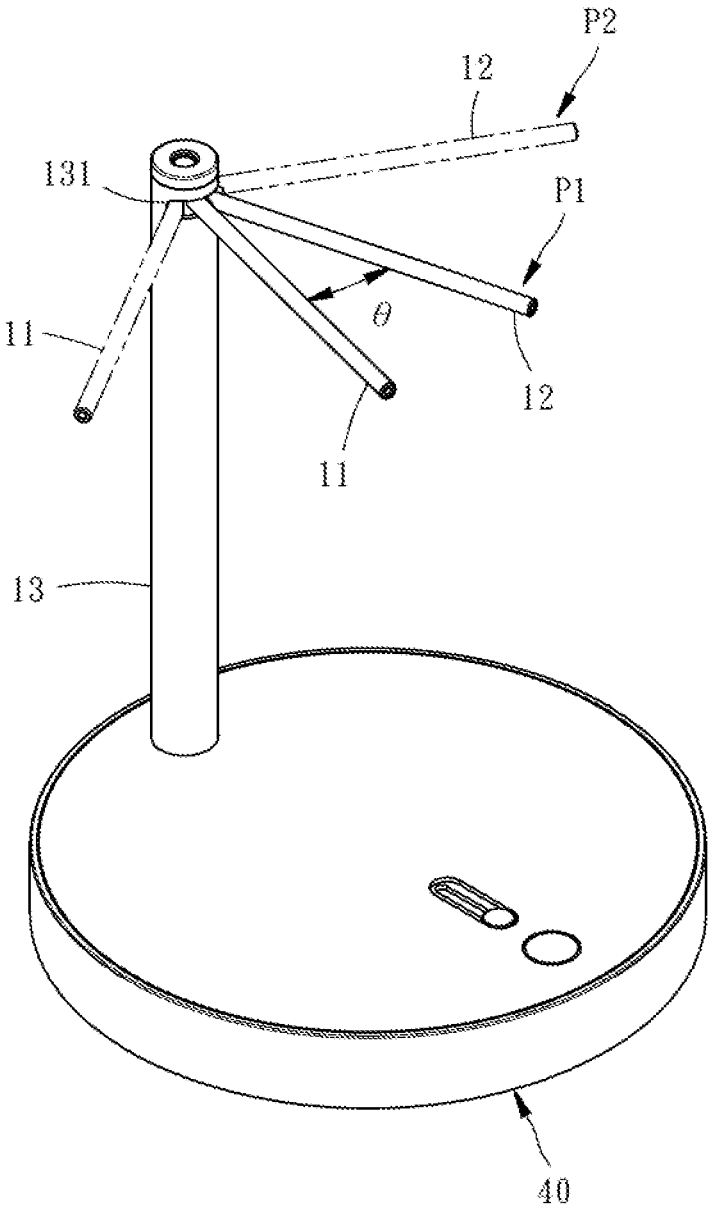
FIG. 8 is an assembled perspective view of the partial furlable lamp, showing a first position and a second position of left and right axles.

As shown in FIGS. 5 and 7, the second left link 56 is fixed to the bottom section of the internal pipe 58, and the left axle 11 is fixed to the top section of the internal pipe 58. As shown in FIGS. 6 and 7, the second right link 57 is fixed to the bottom section of the internal pipe 59, and the right axle 12 is fixed to the top section of the internal pipe 59. As shown in FIGS. 1-2, the left and right axles 11 and 12 are inserted through the slot 131 of the vertical pipe 13 and extend from the vertical pipe 13 toward different directions. The left axle 11 is slidably connected with the left half 21 of the translucent flexible sheet 20 by being inserted through rings 34 located between the left units 321 of the hollow frame pairs 32A and 32B. The right axle 12 is slidably connected with the right half 22 of the translucent flexible sheet 20 by being inserted through rings 35 located between the right units 322 of the hollow frame pairs 32A and 32B. Through the sliding switch 44, the rotary motor 51 of the driving device 50 is controlled by the circuit board 45 to drive nut unit 53 to displace along the threaded rod 52, that drives the links 54-57 and the internal pipes 58 and 59 to rotate, thereby driving the left and right axles 11 and 12 to swing between a first position P1 and a second position P2 as shown in FIG. 8.

Figure 9:
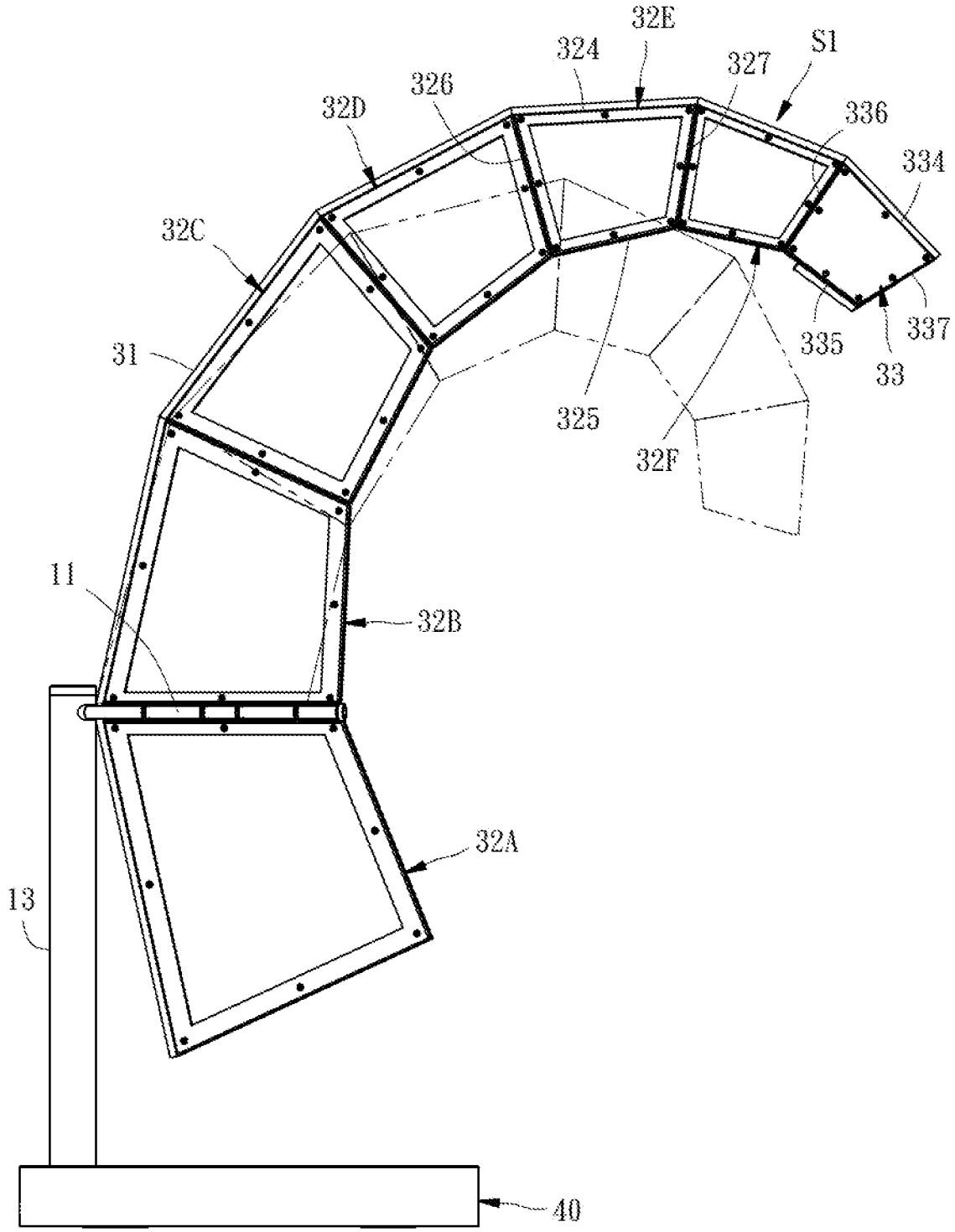
FIGS. 9-10 are side views of the furlable lamp, showing the furling process thereof.

When the left and right axles 11 and 12 are located at the first position P1, the included angle θ therebetween is relatively smaller and the combination of the translucent flexible sheet 20 and the supporting structure 30 is in an unfurled state 51 as shown in FIG. 9. At this time, the opening 15 has the smallest width and the combination of the translucent flexible sheet 20 and the supporting structure 30 is a little curved. In the unfurled state 51, as shown in FIG. 10, the light from the light source is mostly emitted downwardly from a relatively higher position, and a little of the light is emitted out through the translucent flexible sheet 20.

Figure 10:
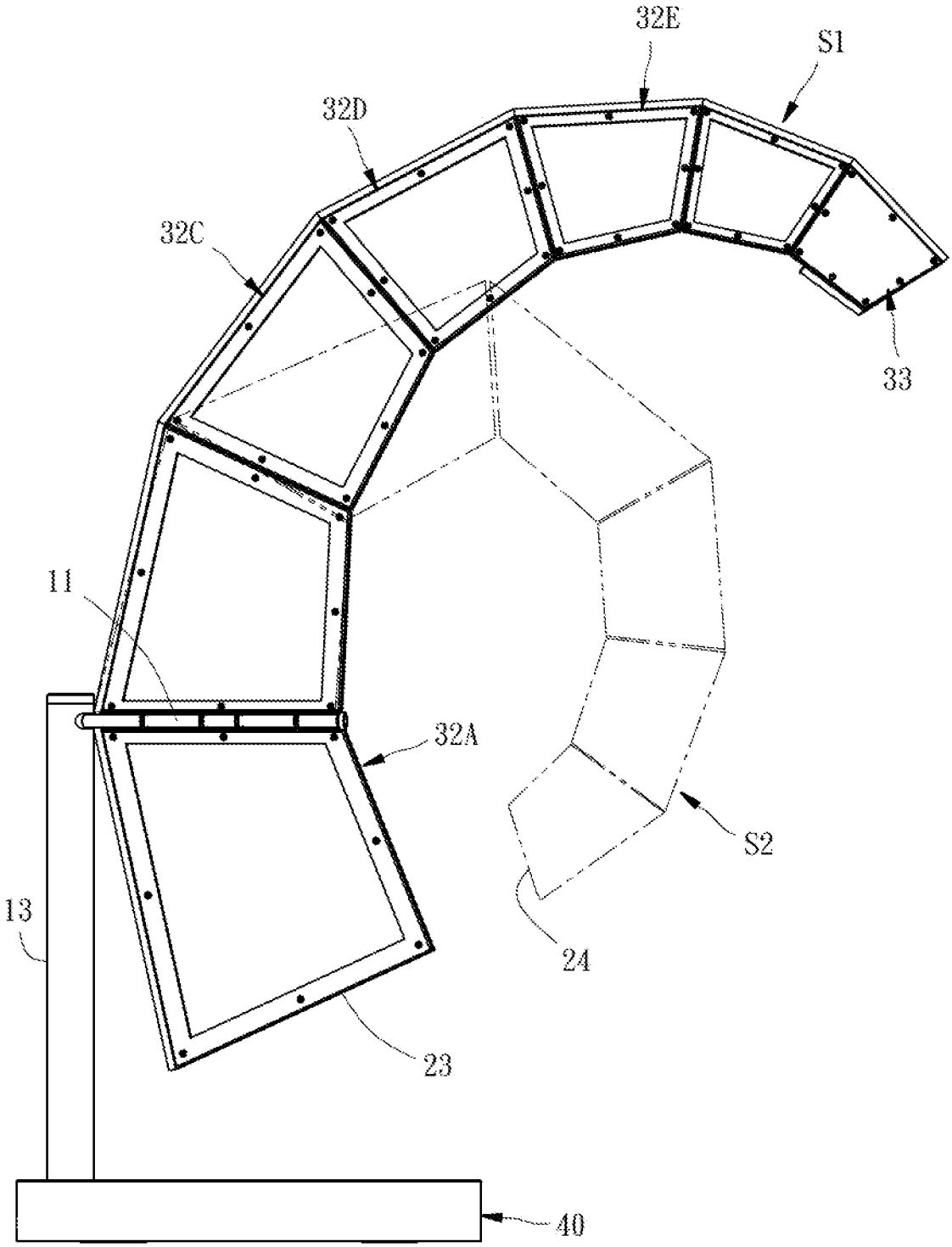

During the process that the left and right axles 11 and 12 swing from the first position P1 to the second position P2, the opening 15 is gradually widened and the combination of the translucent flexible sheet 20 and the supporting structure 30 gradually furls along with the increasing of the width of the opening 15, as shown in FIGS. 9-10. In this process, the combination of the translucent flexible sheet 20 and the supporting structure 30 becomes more and more curved in shape and the light-emitting effect of the furlable lamp 10 is changed accordingly.

When the left and right axles 11 and 12 are located at the second position P2, the included angle θ therebetween is relatively larger and the combination of the translucent flexible sheet 20 and the supporting structure 30 is in a furled state S2 as shown in FIG. 10. At this time, the opening 15 has the largest width, the combination of the translucent flexible sheet 20 and the supporting structure 30 is volute-shaped, the light from the light source is emitted from a relatively lower position into the space 14 and then emitted out through all the exposed parts of the translucent flexible sheet 20.

In other words, the combination of the translucent flexible sheet 20 and the supporting structure 30 is capable of furling and unfurling along with the change of the width of the opening 15, thereby changing the shape and light-emitting effect of the furlable lamp 10. Specifically speaking, when the opening 15 is widened, the combination of the translucent flexible sheet 20 and the supporting structure 30 furls and the light turns inward. Besides, as the light turns inward, the widening of the opening 15 improves the ability of the translucent flexible sheet 20 to capture more of the light on its surfaces, where the light gets diffused, and allows less direct light to escape. Therefore, the furling method serves two mutually beneficial purposes at once. The furling and unfurling motions are resulted from the supporting structure 30 which constrains where the sheet 20 is allowed to bend. The supporting structure 30 accomplishes this through the small distance maintained between each frame which causes the sheet 20 to act as a living hinge.

It can be known from the above description that the molded flexible sheet 20 serves the dual purposes of providing living hinges, and providing translucent panels. Because the sheet 20 allows the creation of many living hinges, it obviates the need to fabricate and attach many mechanical hinges (two for each connecting pair of frames), and simplifies the construction of the lamp, and lowers manufacturing costs.

In this embodiment, the decreasing size of the hollow frame pairs 32A-F and the light base pair 33 causes the amount of furl to vary along the length of the structure so that the second end 24 is directed to the inside of the hollow frame pair 32A in the furled state S2 as shown in FIG. 10. That causes the combination of the translucent flexible sheet 20 and the supporting structure 30 in the furled state to be volute-shaped, not shaped as a closed circle, and thereby locates the light sources 338 inside the structure to illuminate all the exposed parts of the translucent flexible sheet 20.

In this embodiment, the hollow frame pairs 32A-F and light base pair 33 are all the same in shape but progress in size in a logarithmic fashion, and it can result in lower manufacturing costs because the left or right units of the pairs 32A-F and 33 are allowed to be cut in a nested fashion out of a single piece of material, that is just the size of the left or right unit of the largest hollow frame pair 32A. Of course, other size/shape relationships are possible and may be desirable to achieve different forms/behaviors for the lamp.

Figure 11:
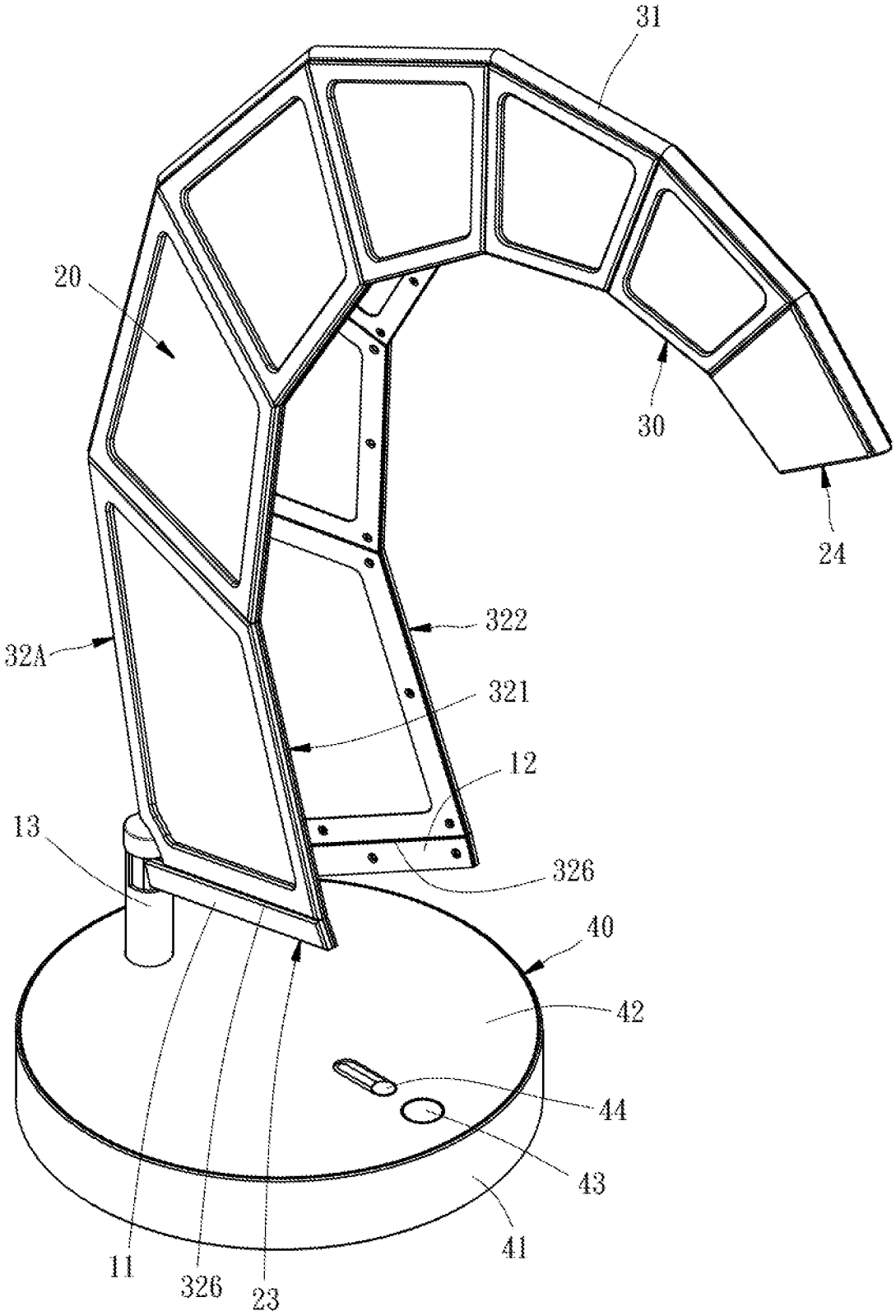
FIG. 11 is an assembled perspective view of a furlable lamp according to a second preferred embodiment of the present invention.
Figure 12:
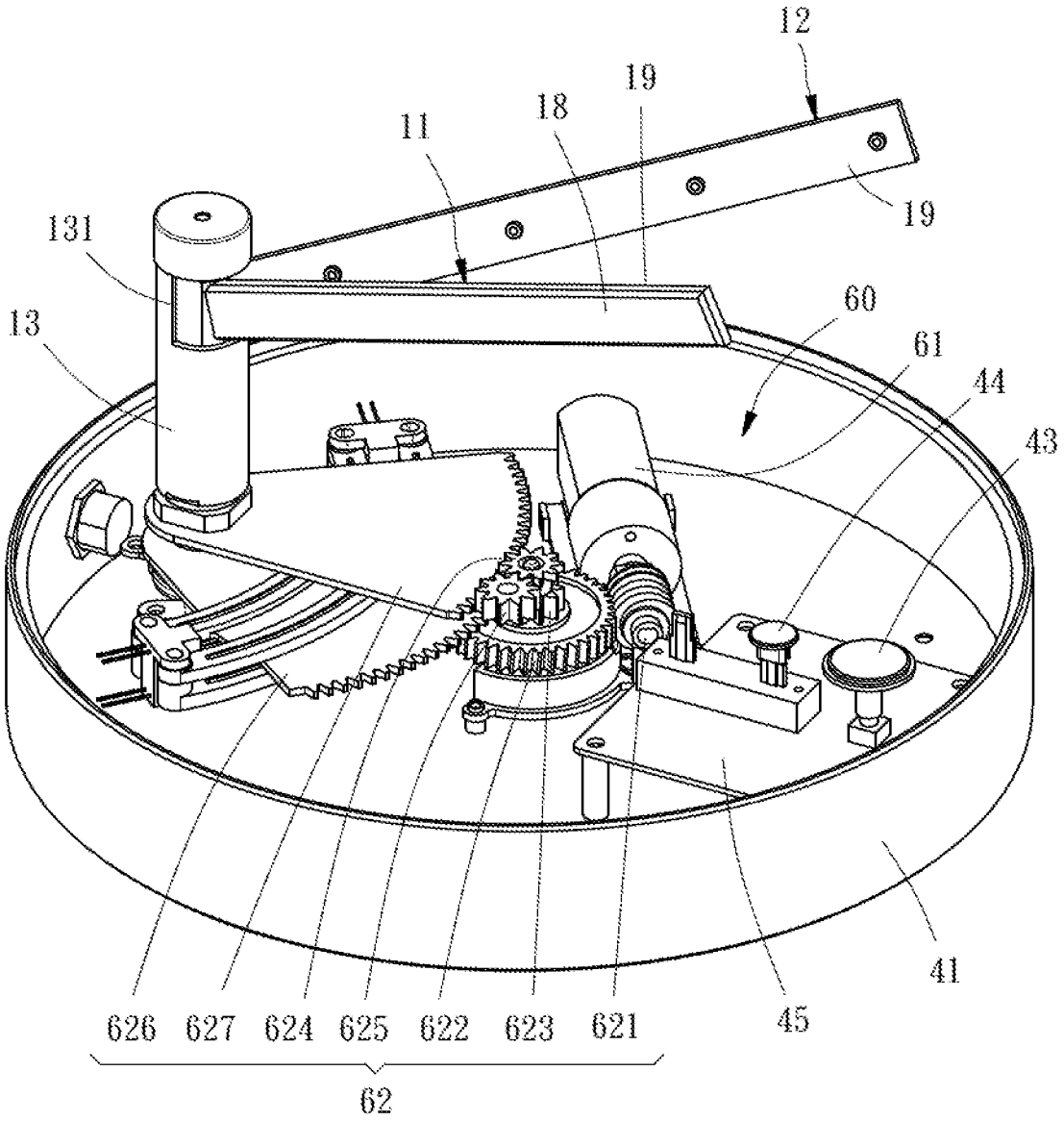
FIG. 12 is approximately an assembled perspective view of a lamp base, a driving device, a vertical pipe and left and right axles of the furlable lamp, but not showing a top cover of the lamp base.
Figure 13:
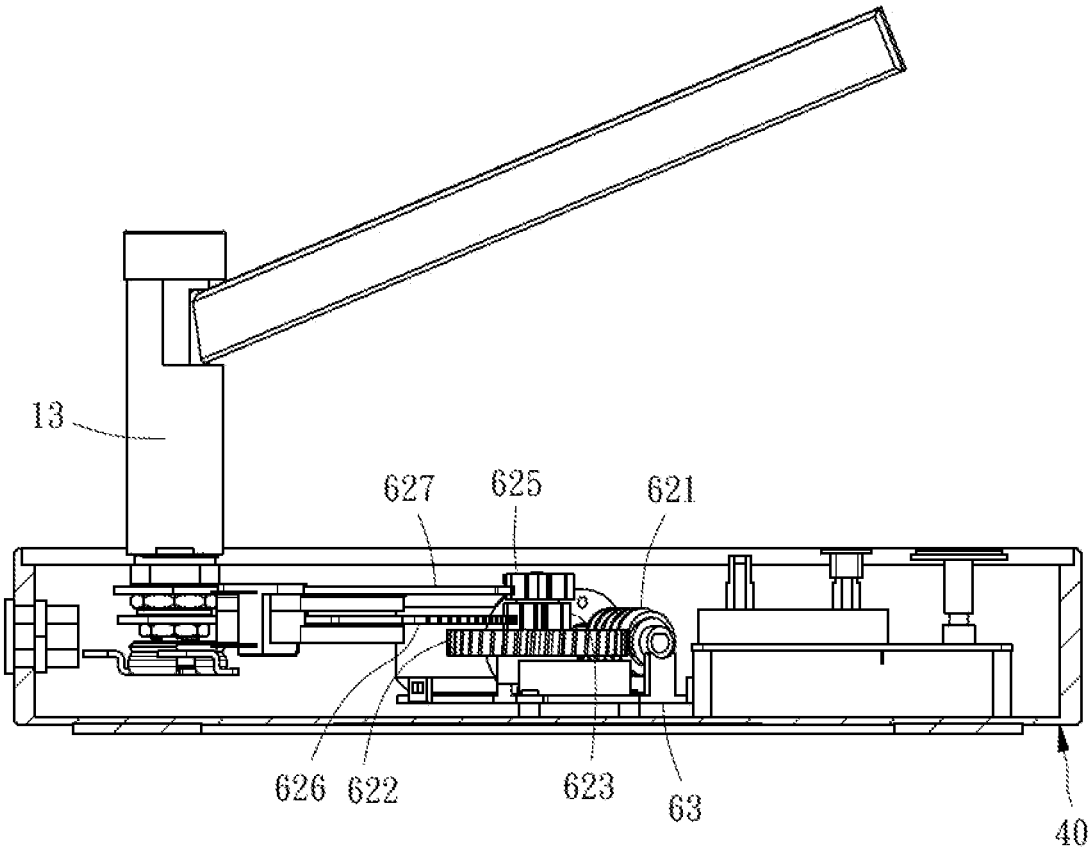
FIG. 13 is a partially sectional view of the furlable lamp.

Referring to FIGS. 11-13, a furlable lamp according to a second preferred embodiment of the present invention is similar to the furlable lamp 10 described in the first preferred embodiment, which are primarily different from each other in the driving device.

The driving device 60 in this embodiment primarily includes a rotary motor 61 and a gear train 62, which are disposed in the lamp base 40, and two internal pipes disposed in the vertical pipe 13. The two internal pipes are similar to the internal pipes 58 and 59 in the afore-described first preferred embodiment and likewise fixed to the left and right axles 11 and 12 respectively, but the internal pipes and vertical pipe 13 in this embodiment is relatively shorter. The gear train 62 includes a worm 621 driven by the rotary motor 61 to rotate, a worm gear 622 engaged with the worm 621, first and second gears 623 and 624 fixed to the worm gear 622, a third gear 625 engaged with the second gear 624, and two sector gears 626 and 627 engaged with the first and third gears 623 and 625 respectively and fixed to the two internal pipes respectively. The aforementioned worm 621, worm gear 622 and first to third gears 623, 624, 625 are disposed in and supported by a housing. For the convenience of illustration, the housing is not shown in FIG. 12, a base 63 of the housing is shown in FIG. 13, but a top cap of the housing, which supports the third gear 625, is not shown in FIG. 13.

As a result, when the rotary motor 61 drives the gear train 62 to rotate, the first and third gears 623 and 625 rotate in opposite directions so that the two sector gears 626 and 627 also rotate in opposite directions to drive the two internal pipes to rotate in opposite directions, thereby attaining the same effect as described in the first preferred embodiment that the left and right axles 11 and 12 are driven to swing between the first and second positions P1 and P2 as shown in FIG. 8.

In addition to the aforementioned difference, the left and right axles 11 and 12 in this embodiment are located adjacent to the third edges 326 of the left and right units 321 and 322 of the hollow frame pair 32A respectively and located at the first end 23 of the translucent flexible sheet 20. Each of the left and right axles 11 and 12 in this embodiment includes two elongated plates 18 and 19. The two elongated plates 18 and 19 of the left axle 11 fix a part of the left half 21 of the translucent flexible sheet 20 therebetween. The two elongated plates 18 and 19 of the right axle 12 fix a part of the right half 22 of the translucent flexible sheet 20 therebetween.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A furlable lamp comprising:

a translucent flexible sheet comprising a left half and a right half hingedly connected with the left half such that the left half and the right half are foldable relative to each other, the translucent flexible sheet being configured in a curved manner with a space within the left half and the right half and an opening gradually narrowed from a first end of the translucent flexible sheet to a second end of the translucent flexible sheet;

a supporting structure connected with the translucent flexible sheet and configured to constrain the translucent flexible sheet to furl in a way that the second end of the translucent flexible sheet moves toward the first end of the translucent flexible sheet when the opening is widened, and constrain the translucent flexible sheet to unfurl in a way that the second end of the translucent flexible sheet moves away from the first end of the translucent flexible sheet when the opening is narrowed; and a light source disposed to the second end of the translucent flexible sheet in the space for emitting light in the space and out of the opening.

2. The furlable lamp as claimed in claim 1, wherein the opening of the translucent flexible sheet is gradually narrowed from a bottom portion thereof to a top portion thereof.

3. The furlable lamp as claimed in claim 1, wherein the furlable lamp further comprises a left axle connected with the left half of the translucent flexible sheet, a right axle connected with the right half of the translucent flexible sheet, and a driving device driving the left and right axles to reciprocatingly swing between a first position and a second position to widen and narrow the opening so as to furl and unfurl the translucent flexible sheet.

4. The furlable lamp as claimed in claim 1, wherein:

the translucent flexible sheet comprises a bent spine connecting the left half and the right half; the opening is located opposite to the spine; the space is located between the spine and the opening;

the supporting structure comprises a plurality of hollow frame pairs and a light base pair; each of the hollow frame pairs and the light base pair comprises a left unit and a right unit shaped identically to each other and fixed on the left half and the right half of the translucent flexible sheet respectively, wherein each of the left units and the right units has a first edge, a second edge located opposite to the first edge and shorter than the first edge, a third edge connecting the first and second edges, and a fourth edge located opposite to the third edge; the left and right units of each of the hollow frame pairs and the light base pair are disposed symmetrically to each other in a way that the first edges thereof are located adjacent to the spine; the hollow frame pairs and the light base pair are arranged one by one from the first end to the second end of the translucent flexible sheet in a way that the fourth edges of the left and right units of one of every two adjacent said hollow frame pairs are located adjacent to the third edges of the left and right units of the other of said every two adjacent said hollow frame pairs, the light base pair is located at the second end of the translucent flexible sheet and the third edges of the left and right units of the light base pair are located adjacent to the fourth edges of the left and right units of one of the hollow frame pairs; and the light source is disposed on the light base pair of the supporting structure.

5. The furlable lamp as claimed in claim 4, wherein each of the left unit and the right unit of each of the hollow frame pairs is a hollow frame comprising two identical pieces to fix a part of the translucent flexible sheet therebetween.

6. The furlable lamp as claimed in claim 4, wherein each of the left unit and the right unit of the light base pair comprises two identical plates to fix a part of the translucent flexible sheet therebetween.

7. The furlable lamp as claimed in claim 4, wherein the furlable lamp comprises a left axle connected with the left half of the translucent flexible sheet, a right axle connected with the right half of the translucent flexible sheet, and a driving device for driving the left and right axles to swing between a first position and a second position; when the left and right axles are located at the first position, an included angle therebetween is relatively smaller and a combination of the translucent flexible sheet and the supporting structure is in an unfurled state; when the left and right axles are located at the second position, the included angle therebetween is relatively larger and the combination of the translucent flexible sheet and the supporting structure is in a furled state.

8. The furlable lamp as claimed in claim 7, wherein the furlable lamp comprises a lamp base and a vertical pipe extending upwardly from the lamp base; the driving device is disposed in the lamp base and the vertical pipe; the left and right axles extend from the vertical pipe and is located adjacent to the largest hollow frame pair.

9. The furlable lamp as claimed in claim 8, wherein the driving device comprises a rotary motor, a threaded rod driven by the rotary motor to rotate, a nut unit screwed onto the threaded rod and driven by the threaded rod to displace along the threaded rod, a first left link and a first right link rotatably connected to the nut unit, a second left link and a second right link rotatably connected to the first left link and the first right link respectively, and two internal pipes disposed in the vertical pipe; the second left link and the left axle are fixed to one of the internal pipes; the second right link and the right axle are fixed to the other internal pipe.

10. The furlable lamp as claimed in claim 8, wherein the driving device comprises a rotary motor, a gear train driven by the rotary motor, and two internal pipes driven by the gear train to rotate in opposite directions simultaneously; the two internal pipes are disposed in the vertical pipe and fixed to the left axle and the right axle respectively.

11. The furlable lamp as claimed in claim 10, wherein the gear train comprises a worm driven by the rotary motor to rotate, a worm gear engaged with the worm, first and second gears fixed to the worm gear, a third gear engaged with the second gear, and two sector gears engaged with the first and third gears respectively and fixed to the two internal pipes respectively.

12. The furlable lamp as claimed in claim 7, wherein when the combination of the translucent flexible sheet and the supporting structure is in the furled state, the second end of the translucent flexible sheet is directed to an inside of one of the hollow frame pairs.

13. The furlable lamp as claimed in claim 4, wherein the hollow frame pairs and the light base pair are arranged in order of decreasing size from the first end to the second end of the translucent flexible sheet.

14. The furlable lamp as claimed in claim 13, wherein for each of the left units and the right units of the hollow frame pairs and the light base pair, the fourth edge is shorter than the third edge; the fourth edges of the left and right units of one of every two adjacent said hollow frame pairs are sized identically to the third edges of the left and right units of the other of said every two adjacent said hollow frame pairs; the third edges of the left and right units of the light base pair are sized identically to the fourth edges of the left and right units of the smallest hollow frame pair.

15. The furlable lamp as claimed in claim 13, wherein a combination of the translucent flexible sheet and the supporting structure is capable of furling between an unfurled state and a furled state; the opening of the translucent flexible sheet has a smallest width in the unfurled state and has a largest width in the furled state; when the combination of the translucent flexible sheet and the supporting structure is in the furled state, the second end of the translucent flexible sheet is directed to an inside of one of the hollow frame pairs.

* * * * *